US006450894B1

(12) United States Patent
Sun et al.

(10) Patent No.: US 6,450,894 B1
(45) Date of Patent: Sep. 17, 2002

(54) GOLF PUTTER HEAD WITH WEIGHTED TOE AND HEEL PORTIONS

(75) Inventors: Donald J. C. Sun, Young Ann Hsiang; Ching-Chung Chiu, Tainan Hsien, both of (TW)

(73) Assignee: CIPA Manufacturing Corp., Hsiang (TW)

( * ) Notice: Subject to any disclaimer, the term of this patent is extended or adjusted under 35 U.S.C. 154(b) by 0 days.

(21) Appl. No.: 09/649,750

(22) Filed: Aug. 28, 2000

(51) Int. Cl.[7] ..... A63B 69/36; A63B 53/04

(52) U.S. Cl. ..... 473/252; 473/253; 473/341; 473/342; 473/334

(58) Field of Search ..... 473/251, 252, 473/253, 254, 334, 335, 336, 337, 338, 339, 340, 341, 242, 244, 256, 349, 350, 342, 324

(56) References Cited

U.S. PATENT DOCUMENTS 3,042,405 A * 7/1962 Solheim
3,516,674 A * 6/1970 Scarborough
3,967,826 A 7/1976 Judice
4,444,395 A 4/1984 Reiss
4,852,879 A 8/1989 Collins
4,872,684 A 10/1989 Dippel
4,979,744 A * 12/1990 Alcala
5,090,698 A 2/1992 Kleinfelter
5,308,067 A * 5/1994 Cook
5,501,461 A 3/1996 Donofrio
5,509,660 A * 4/1996 Elmer
5,605,510 A * 2/1997 Schmidt
5,690,562 A * 11/1997 Sturm
5,728,007 A * 3/1998 Eakin
5,913,731 A * 6/1999 Westerman
5,938,543 A * 8/1999 McGeeney
6,086,484 A * 7/2000 Uebelhor
6,095,931 A * 8/2000 Hettinger

* cited by examiner

*Primary Examiner*—Sebastiano Passaniti
(74) *Attorney, Agent, or Firm*—Edward A. Sokolski

(57) ABSTRACT

A golf putter head has a central portion made of a relatively light weight material such as a light alloy of extruded aluminum or extruded plastic alloy. To further reduce the weight of the central portion, this portion may be extruded and the face plate formed from a light polymer or rubber material. The toe and heel portions of the head are separately formed of a relatively heavy material such as sintered tungsten or tungsten copper. The toe and heel portions are similar to each other and are attached to the central portion by means of pins which fit into opposing holes formed in the ends of the central portion and the toe and heel end portions as well as well as screws which fit through apertures in the end portions and engage threads formed in the central portion. Employing a central portion which is much lighter in weight than the end portions provides an anti-twisting motion of inertia to the club head.

4 Claims, 4 Drawing Sheets

GOLF PUTTER HEAD WITH WEIGHTED TOE AND HEEL PORTIONS

BACKGROUND OF THE INVENTION

1. Field of the Invention

This invention relates to golf club putters and more particularly to such a putter having weighted heel and toe portions.

2. Description of the Related Art

It has been found that the performance of golf putters can be improved if the end portions(toe and heel) are weighted so that they have substantially higher weights than the central portion of the putter. It has been found that such end weighting maximizes the anti-twist moment of inertia of the club to facilitate for more accurate putting.

Putters with weighted ends are described in U.S. Pat. No. 5,501,461 issued Mar. 26, 1996 to Donofrio; U.S. Pat. No. 4,852,879 issued Aug. 1, 1989 to Collins; U.S. Pat. No. 4,444,395 issued Apr. 24, 1984 to Reiss; and U.S. Pat. No. 4,872,684 issued Oct. 10, 1989 to Dippel; While providing the desired toe and heel weighting, these end weights are either integrally formed with the central portion or if separately formed permanently installed in the end portions. This has the disadvantage of not permitting the ready changing of the end weights should the situation so dictate, as in the present invention. Further, there is no indication in these prior art patents of providing a face plate for the head of a light material which can be installed in a cavity formed in the central portion which is a further feature of applicant's invention.

SUMMARY OF THE INVENTION

The device of the present invention has a central portion made of a lightweight metal alloy such as an extruded aluminum. To further lighten the central portion, a cavity is formed therein with a faceplate of a light polymer or a rubber composite being installed in this cavity. The toe and heel end portions are fabricated of a heavy material such sintered tungsten or tungsten copper. These end portions are removably attached to the central portion by means of pins which fit into cavities in the end and central portions and screws which pass through holes in the end portions and threadably engage the central portion.

The device of the present invention thus provides the desired anti-twist moment of inertia in a device having a lower weight for the central portion and readily removable heel and toe end portions so that these can be changed to provide different weighting should the situation so dictate.

It is therefore an object of this invention to make for an improved anti-twist golf putter;

It is a further object of this invention to provide an improved putter head having an anti-twist moment of inertia with high weight heel and toe portions which can readily be removed and replaced with end portions having a different weight;

Other objects of the invention will become apparent as the description proceeds in connection with the accompanying drawings.

DETAILED DESCRIPTION OF THE INVENTION

Figures 1, 2:
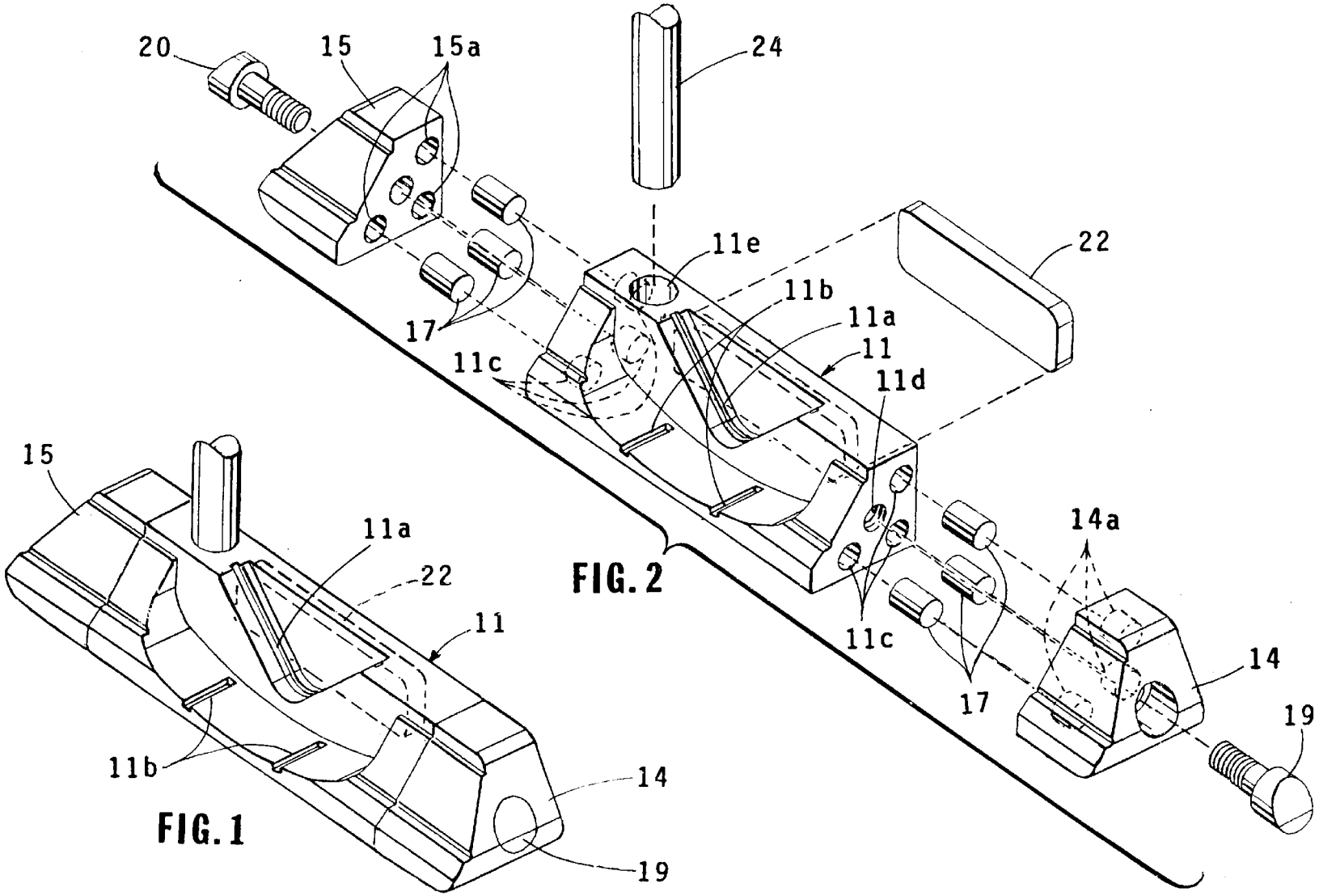
FIG. 1 is a rear top perspective view of a first embodiment of the invention.
FIG. 2 is a top rear exploded view of the first embodiment.
Figure 3:
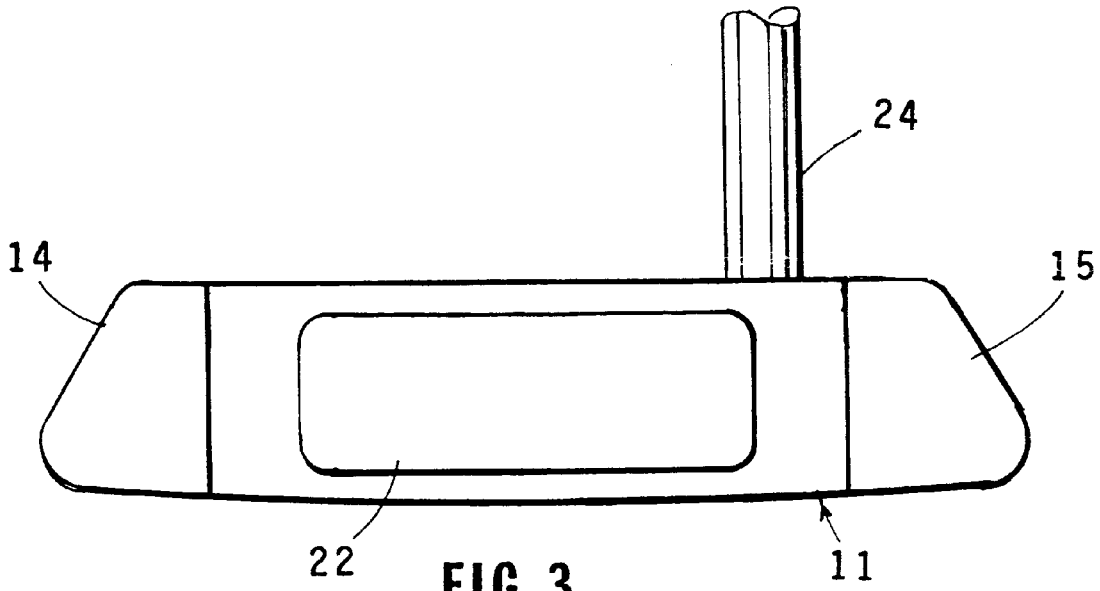
FIG. 3 is a front elevational view of the first embodiment.
Figure 4:
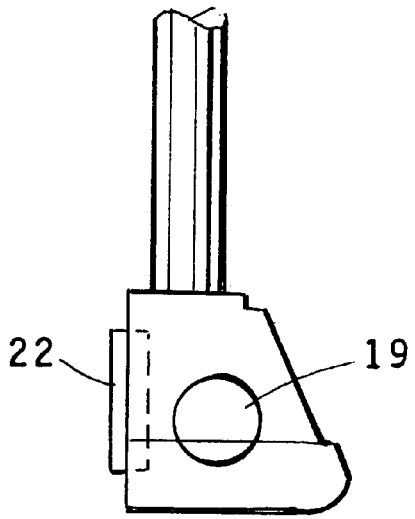
FIG. 4 is an end elevational view of the first embodiment.

Referring now to FIGS. 1–4, a first embodiment of the invention is illustrated. Central portion 11 is fabricated of a light weight metal such as extruded aluminum or pre-injected plastic alloy. A V-shaped sight 11*a* is grooved into the central portion forming an opening in the surface of the central portion. Sight 11*a* and sight lines 11*b* can be used for aiming the putter.

Toe end portion 14 and heel end portion 15 are fabricated of a heavy metal such as sintered tungsten or tungsten copper. The end portions are removably joined to the central portion by means of pins 17 which fit into mating apertures 11*c* formed on both ends of the central portion and similar apertures 14*a* and 15*a* formed in toe and heel end portions 14 and 15 respectively. The end portions are retained to the central portion by means of screws 19 and 20 which threadably engage threaded holes 11*d* in the central portion. A face plate 22 fabricated of a light weight material such as a light weight polymer or a rubber composite is cemented into a recessed portion of the face of the central portion. A shaft hole lie is formed in the top of the central portion, the club drive shaft 24 being installed in this hole.

Figures 5, 6:
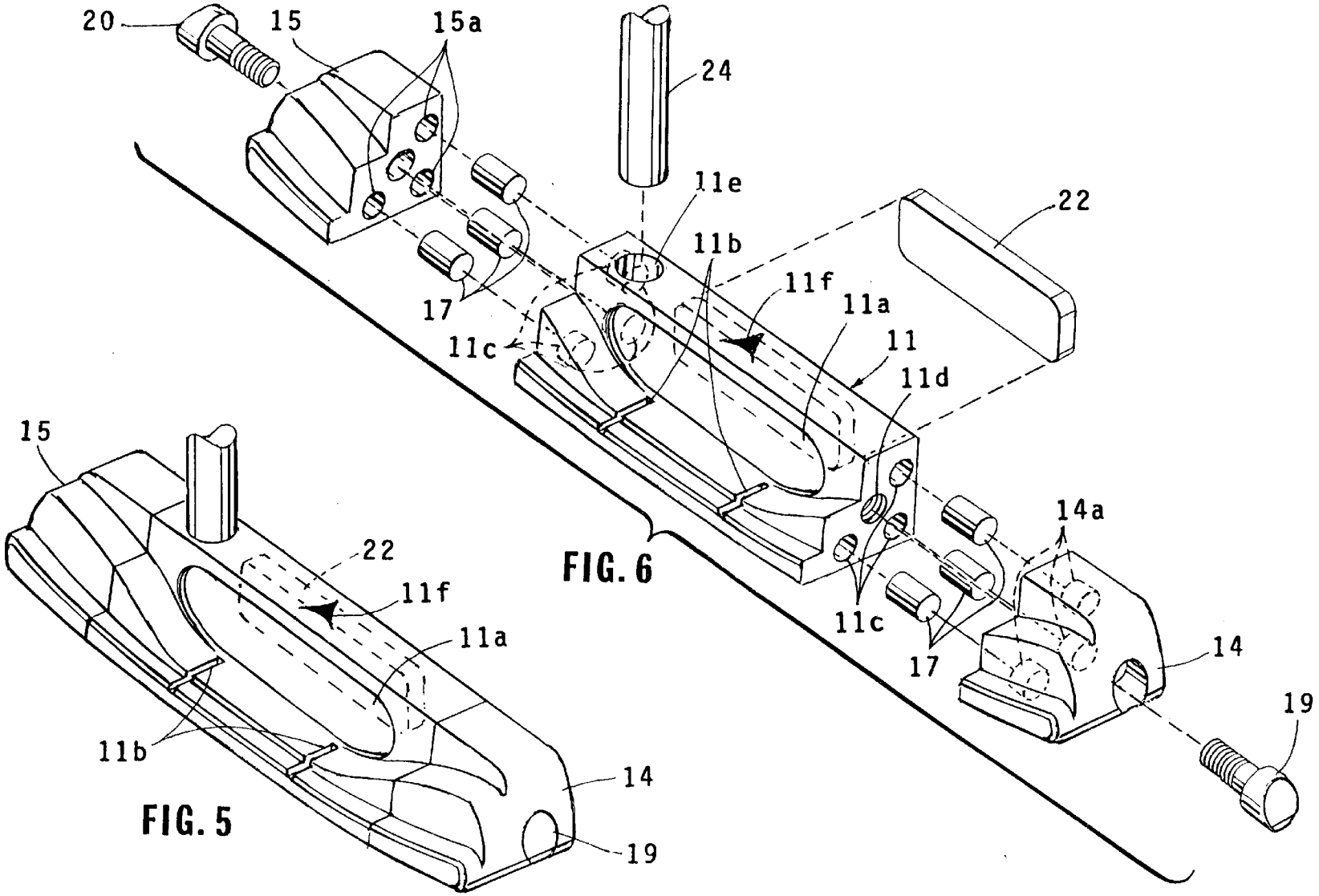
FIG. 5 is a top rear perspective view of a second embodiment of the invention.
FIG. 6 is a top rear perspective exploded view of the second embodiment.
Figures 7, 8, 9:
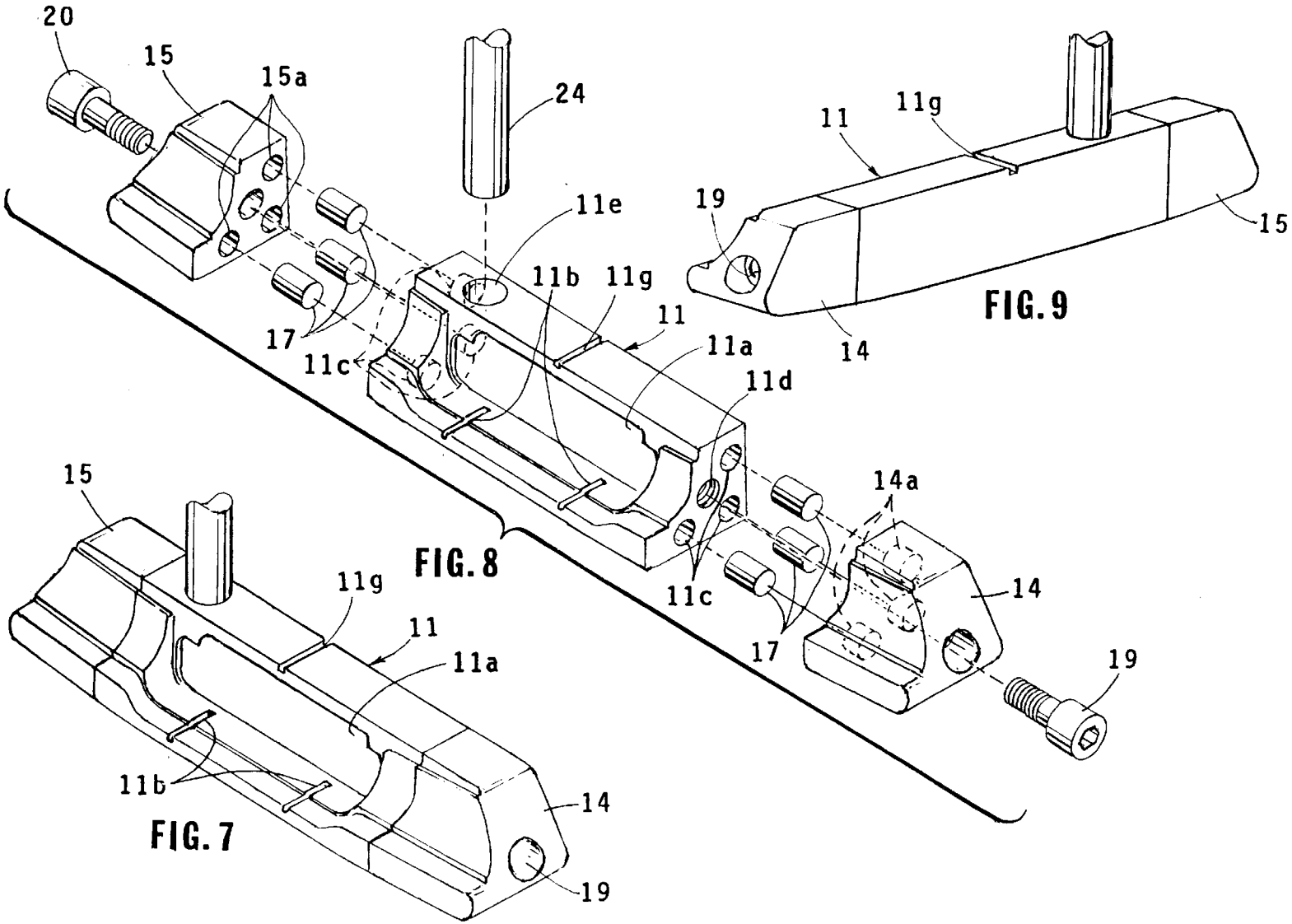
FIG. 7 is a top rear perspective view of a third embodiment of the invention.
FIG. 8 is a top rear perspective exploded view of the third embodiment.
FIG. 9 is a top front perspective view of the third embodiment.

Referring now to FIGS. 6 and 7, a second embodiment of the invention is illustrated. This second embodiment is generally similar to the first embodiment and like numerals have been used to identify like parts of the first embodiment.

The second embodiment differs from the first in that toe and heel end pieces 14 and 15 have a stepped shape. Secondly, in the second embodiment the opening 11*a* in the central portion is oval in shape and does not act as an aiming device. The face plate 22 is similar to that of the first embodiment and fits into the open part of the central portion and is cemented thereto. Thirdly, the aiming device is formed by an engraved pointer 11*f* which can be used in conjunction with marker lines 11*b*. Otherwise, the second embodiment is the same as the first.

Referring now to FIGS. 7, 8 and 9, a third embodiment of the invention is shown. This embodiment is closely similar to the first and second embodiments and like numerals have been utilized to identify like parts. This embodiment differs from the first two in that no opening is formed in the central portion 11 for either aiming purposes or for receiving a face plate. The face plate rather is integrally formed with the central portion. Further, the toe and heel end portions have a different shape than the other embodiments. In addition, aiming is facilitated by means of the two spaced markers 11*b* in conjunction with a third marker 11*g* on the top surface of the central portion otherwise, the third embodiment is the same as the first two.

While the invention has been described in detail, it is to be understood that this is intended by way of illustration and example only, the scope of the invention being limited by the terms of the following claims.

We claim:

1. A golf putter head comprising:

a central portion fabricated of a light weight material, said central portion having a plurality of apertures formed in the opposite ends thereof and a front wall having an opening formed therein;

a face plate of light weight material installed in said opening in the front wall of said central portion, said face plate being cemented to said central portion;

toe and heel end portions of a substantially heavier material than said central portion, said toe and heel end portions having a plurality of apertures formed in the inner surfaces thereof;

pins fitted in the apertures of both said central portion and said toe and heel end portions for removably attaching said end portions to said central portion; and screws fitted through said end portions and threadably engaging said central portion for removably retaining said end portions to said central portion;

whereby the heavier weight of said end portions provides an anti-twist moment of inertia to said putter head.

2. The device of claim 1 wherein said toe and heel end portions have a stepped configuration.

3. A golf putter head comprising:

a central portion fabricated of a light weight material, said central portion having a plurality of apertures formed in the opposite ends thereof;

toe and heel end portions of a substantially heavier material than said central portion, said toe and hell end portions having a plurality of apertures, formed in the inner surfaces thereof;

pins fitted in the apertures of both said central portion and said toe and heel end portions for removably attaching said end portions to said central portion;

screws fitted through said end portions and threadably engaging said central portion for removably retaining said end portions to said central portion;

said central portion having a front wall with a V-shaped opening formed therein, said V-shaped opening forming an aiming device; and a face plate installed in said opening;

whereby the heavier weight of said end portions provides an anti-twist moment of inertia to said putter head.

4. The device of claim 3 wherein said toe and heel end portions have a stepped configuration.

* * * * *